US006905283B1

(12) United States Patent
Salyer, Sr.

(10) Patent No.: US 6,905,283 B1
(45) Date of Patent: Jun. 14, 2005

(54) ENERGY ABSORBING SAFETY BARRIER SYSTEM AND METHOD

(76) Inventor: David C. Salyer, Sr., 755 Tysons Forest Dr., Rock Hill, SC (US) 29732-2851

( * ) Notice: Subject to any disclaimer, the term of this patent is extended or adjusted under 35 U.S.C. 154(b) by 0 days.

(21) Appl. No.: 10/772,007

(22) Filed: Feb. 5, 2004

Related U.S. Application Data

(63) Continuation-in-part of application No. 10/289,022, filed on Nov. 7, 2002, now abandoned.

(51) Int. Cl.[7] ..... E01F 9/018
(52) U.S. Cl. ..... 404/10; 404/9; 404/6
(58) Field of Search ..... 404/6–10, 212; 256/13.1

(56) References Cited

U.S. PATENT DOCUMENTS

| | | | | |
|---|---|---|---|---|
| 2,974,934 | A * | 3/1961 | White | 256/13.1 |
| 3,982,734 | A * | 9/1976 | Walker | 256/13.1 |
| 4,583,716 | A * | 4/1986 | Stephens et al. | 256/13.1 |
| 4,662,611 | A | 5/1987 | Ruane | |
| 5,797,592 | A | 8/1998 | Machado | |
| 5,921,702 | A | 7/1999 | Fitch | |
| 6,309,140 | B1 * | 10/2001 | Kiedaisch et al. | 405/215 |
| 6,533,495 | B1 | 3/2003 | Williams et al. | |
| 6,551,010 | B1 * | 4/2003 | Kiedaisch et al. | 404/6 |
| 6,554,530 | B2 * | 4/2003 | Moore | 404/6 |
| 6,702,511 | B2 * | 3/2004 | Russell | 404/6 |
| 6,773,201 | B2 * | 8/2004 | Witcher | 404/6 |

* cited by examiner

*Primary Examiner*—Robert E. Pezzuto
*Assistant Examiner*—Raymond W. Addie
(74) *Attorney, Agent, or Firm*—John D. Gugliotta; Olen L. York, III

(57) ABSTRACT

An energy absorbing safety barrier system comprising a plurality of plates and a plurality of fins affixed to the plates. The plates are affixed to a stationary object, such as a retaining wall on a motor racing track, via mechanical fasteners. The fins are equidistantly spaced from adjacent fins and set at a specified angle in relation to the normal direction of vehicle traffic. The specified angle of the fins optimizes the dissipation of impact energy through the fin, the energy displacing adjacent fins into one another and further dissipating through friction and energy required to displace the fins.

8 Claims, 4 Drawing Sheets

ENERGY ABSORBING SAFETY BARRIER SYSTEM AND METHOD

RELATED APPLICATIONS

This is a continuation-in-part of U.S. patent application Ser. No. 10/289,022, filed on Nov. 7, 2002, now abandoned.

BACKGROUND OF THE INVENTION

1. Field of the Invention

The present invention relates generally to an energy absorbing apparatus and, more particularly, to an energy absorbing safety barrier for motor racing that dissipates energy generated by collision impact and thereby reduces the energy transferred to the automobile and driver.

2. Description of the Related Art

The increasing popularity of motor racing, including open-wheel, stock car and motorcycling, has also raised an awareness of driver and fan safety. Of paramount concern is the devastating injuries and damage resulting from high impact collisions of vehicle to retaining wall, wherein vehicle speeds of 200 miles per hour are frequently attained. Upon impact, the energy generated by the collision is ineffectively dissipated and is often absorbed by the vehicle and the driver by dramatic changes in vector and velocity, the vector change usually oriented in the direction opposite the impact. Failure to dissipate collision energy results in significant body and engine destruction of the vehicle, and significant bodily injury or even death to driver. Many devices have been developed to combat the various problems that arise in the seconds during a high impact collision, including improvements to retaining walls and improvements to on-board safety equipment.

In the area of on-board safety equipment, items such as the HANS® device (the embodiment of U.S. Pat. Nos. 4,638,510 and 6,009,556, each issued to Robert Hubbard) and improved safety belts have reduced the resultant injuries of high collision impact. The HANS® device is believed to reduce the potential for head, neck and chest injuries by reducing the pull on the neck and head upon impact, thus reducing the neck loads that often result in basal skull fractures, a common injury that causes death among motor racing drivers. However, such devices provide only a single solution to a complex problem, with success highly dependent upon proper use and maintenance of the device. Furthermore, on-board improvements provide little protection to on-looking fans.

Numerous solutions have been proposed for reducing the kinetic energy direction to vehicle and driver upon impact with a retaining wall. An exemplary embodiment of such improvements is found in U.S. Pat. No. 6,554,530, issued in the name of Moore, disclosing an energy absorbing system and method, wherein a plurality of steel plates are affixed to the retaining wall at an angle via corresponding hinges, with an absorbing unit positioned between each plate and the wall. Thus, when a vehicle strikes the plates, the energy is dissipated through successive plates as the plates pivot about the hinges, with the absorbing units also dissipating energy.

Another embodiment is found in U.S. Pat. No. 6,533,495, issued in the name of Williams et al., disclosing an impact absorbing barrier comprising a plurality of deformable angled panel members connected to a rigid member, the rigid member affixed against the retaining wall. The deformable material of the panel members and the angled relationship of the panel members to the wall act in conjunction to absorb, dissipate and deflect impact energy so as to decelerate and redirect the impacting object (vehicle).

However, the aforementioned embodiments suffer from several deficiencies. Notably, the manufacture of the Moore invention, specifically the cushion, requires conventional molding techniques, including rotational molding, vacuum forming, blow molding or injection molding, which requires significant expense and time to produce. The cushion is formed from a number of polymeric materials, the casing for the cushion is formed from a linear polyethylene (LLDPE), and the filler is polyethylene or polyester foam. To counteract any degradation to the polymeric materials, a UV stabilizer is incorporated therein. Furthermore, the cushion is affixed via adhesives, hook and loop material or various fasteners. The present invention avoids the use of any molding technique, since the present invention may be manufactured from ordinary welding facilities, thereby reducing the overall cost of production. The present invention does not use polymeric materials, thus the risk of UV degradation is removed. Finally, by not using polymeric materials, unnecessary quantities of adhesives, hook and loop material or fasteners are not consumed. The Williams et al. invention, and others similar thereto, are notable for two differing results: rebounding of the vehicle and sticking of the vehicle, each dependent upon the firmness or softness of the absorbing material within the panels. For instance, if the material is too firm, the energy will be redirected to the vehicle, causing the vehicle to rebound into racing traffic, thereby further exposing the driver and passing drivers to collision danger. Conversely, if the material is too soft, the vehicle may "stick" or be absorbed by the panels, which results in improper dissipation of the energy and may further result in the vehicle continuing up the retaining wall into the air, thus causing the vehicle to twist and turn before returning to the track. The present invention does not use absorbing materials that can result in such rebounding or sticking problems.

Consequently, there exists a continuous need for new ideas and enhancements for existing products in the motor racing industry, especially directed toward improved safety retaining walls that reduce destruction, damage and injury to vehicle, driver and fan.

SUMMARY OF THE INVENTION

It is therefore an object of the present invention to provide an energy absorbing safety barrier system for absorbing and dissipating energy generated by a vehicle colliding or impacting a stationary object.

It is a feature of the present invention to provide a system having a plurality of plates affixed to the stationary object by fasteners, the plates fabricated from a mild steel that is malleable and deformable, thus effective in absorbing and dispersing energy away from the impacting vehicle. The plates are affixed in an adjacent manner, with one margin of one plate overlapping an adjacent margin of the adjacent plate.

It is another feature of the present invention to provide a system wherein a plurality of fins are affixed to the plates. The fins are fabricated from mild steel and are affixed at specified angles in relation to the normal direction of traffic, the fins operating to absorb the initial impact, deflect energy generated by the impact onto subsequently adjacent fins, and disperse or dissipate the energy away from the impacting vehicle. Individual fins are affixed to a corresponding plate via a weld that traverses the entire height or length of a long side of the fin.

Briefly described according to one embodiment of the present invention, an energy absorbing safety barrier system comprising a plurality of plates and a plurality of fins affixed to the plates. The plates are affixed to a stationary object, such as a retaining wall on a motor racing track, via mechanical fasteners. The fins are equidistantly spaced from adjacent fins and set at a specified angle in relation to the normal direction of vehicle traffic. The specified angle of the fins optimizes the dissipation of impact energy through the fin, the energy displacing adjacent fins into one another and further dissipating through friction and energy required to displace the fins.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within FIGS. 1 through 7.

1. Detailed Description of the Figures

Figure 1:
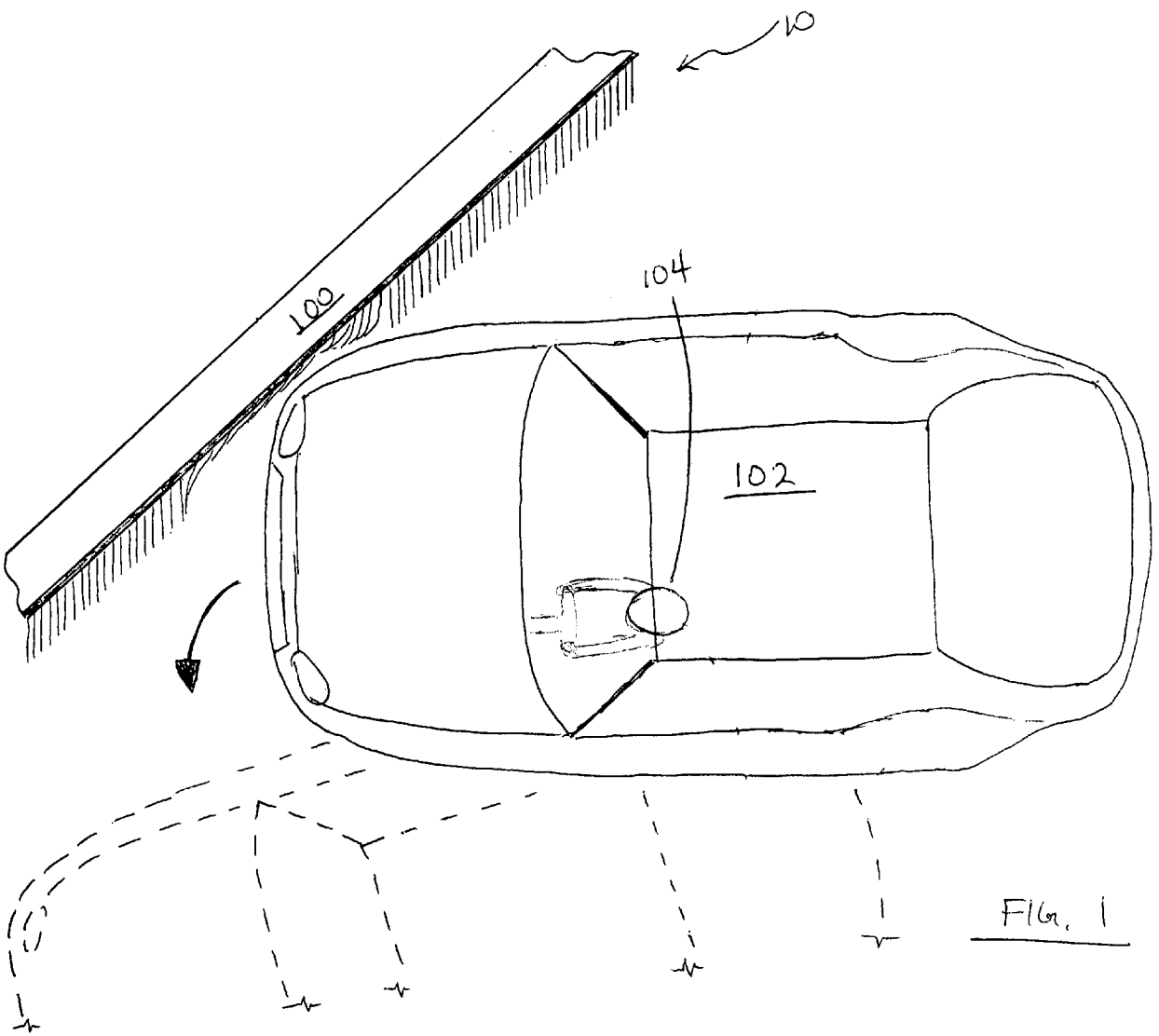
FIG. 1 is a perspective view of a motor vehicle striking the energy absorbing safety barrier attached to a retaining wall, the displacement of fins and the vehicle visible.
Figure 2:
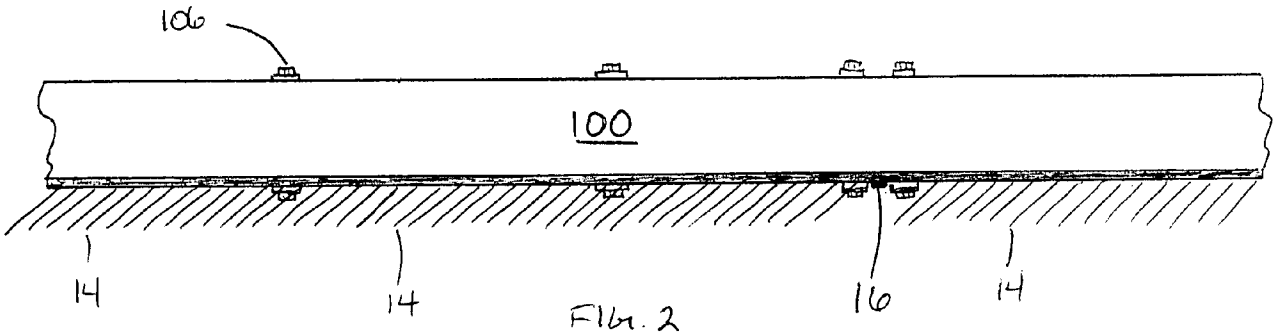
FIG. 2 is a top view of the system comprising plates affixed to a retaining wall, the plates having a plurality of fins aligned at a specified angle in relation to the normal direction of traffic.
Figure 4:
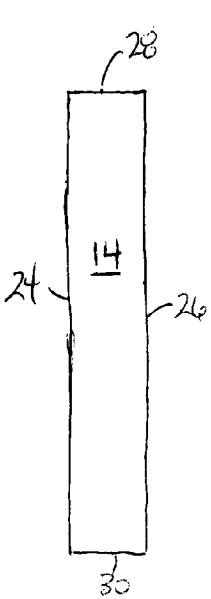
FIG. 4 is a side view of a fin.

Referring to FIG. 1, an energy absorbing safety barrier system and method 10 (hereinafter "system"), is shown in accordance to a preferred embodiment of the present invention. The system 10 comprises a plurality of plates 12 and a plurality, of fins 14 depending therefrom. The plates 12 are affixed to a retaining wall 100 so that the plurality of fins 14 are exposed to or facing vehicle traffic. When a vehicle 102 strikes a fin or fins 14, the kinetic energy generated by the impact is dissipated and/or distributed to adjacent fins 14, thereby decelerating the vehicle 102 to minimize kinetic energy transmitted through the vehicle 102 to the driver 104, and having the effect of reducing structural damage to the vehicle 102 and minimizing injuries to the driver 104.

Figure 3:
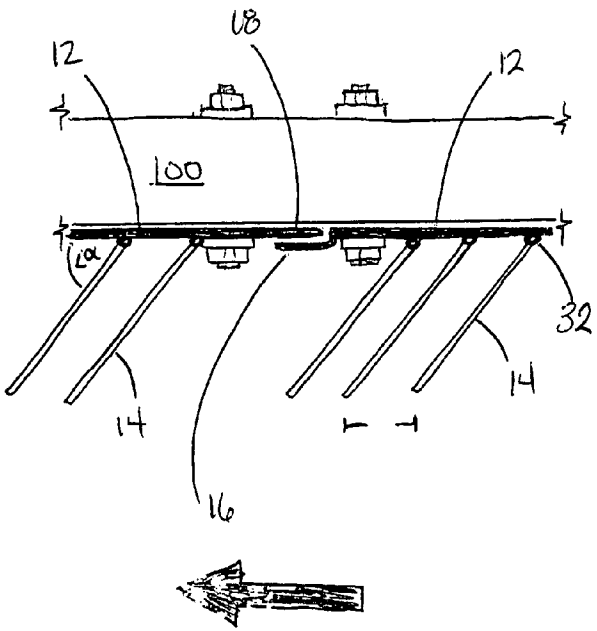
FIG. 3 is a magnified top view of the system at the junction and overlap of adjacently affixed plates, each plate having an offset margin overlapping a planar margin.
Figure 5:
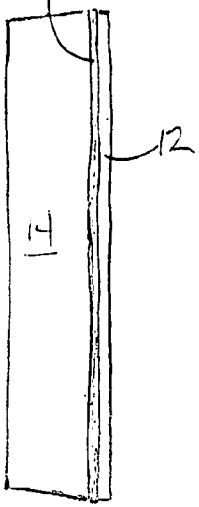
FIG. 5 is a side view of a fin affixed to a plate by a weld.
Figure 6:
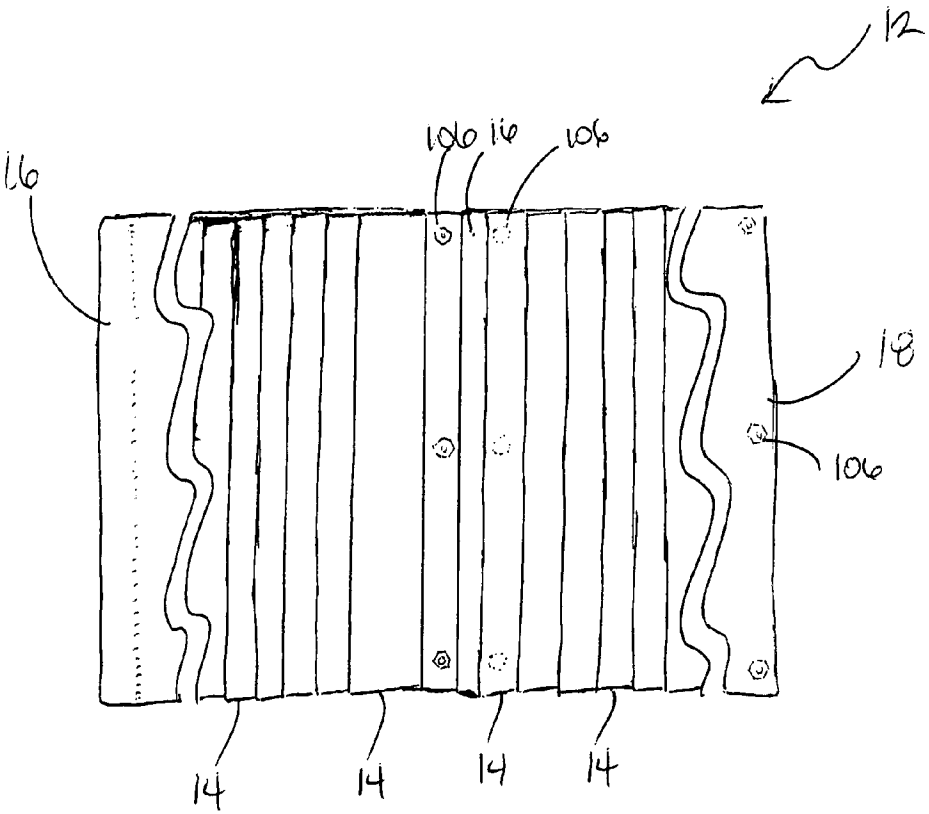
FIG. 6 is a front view of the plate and fins.

Each plate 12 is affixed to the retaining wall 100 via fasteners 106, such as threaded screws or bolts and secured by washers and nuts. At least four fasteners 106 are envisioned for securing the plate 12 to the wall 100, although the addition of two or four fasteners per plate 12 (for a total of six or eight fasteners per plate 12) is ideal. The plate 12 comprises a generally orthogonal configuration (shown as a rectangular plate in the figures). The plate 12 includes a vertically disposed non-planar margin 16 offset from a plane of the plate 12. The plate 12 also includes a vertically disposed planar margin 18, opposite margin 16, coextensive with the plane of the plate 12. As best seen in FIG. 3, the non-planar margin 16 overlaps the planar margin 18 of an adjacent plate 12. The overlap of margins 16 and 18 of adjacent plates 12 operates to inhibit the shearing, tearing, fracturing or peeling of portions of the plates 12, and further inhibits the dispersal of any fractured objects onto a road surface or racing track, into or through the vehicle, or into the crowd. A superior horizontal margin 20 and an inferior horizontal margin 22 bound the remaining edges of the plate 12.

Figure 7:
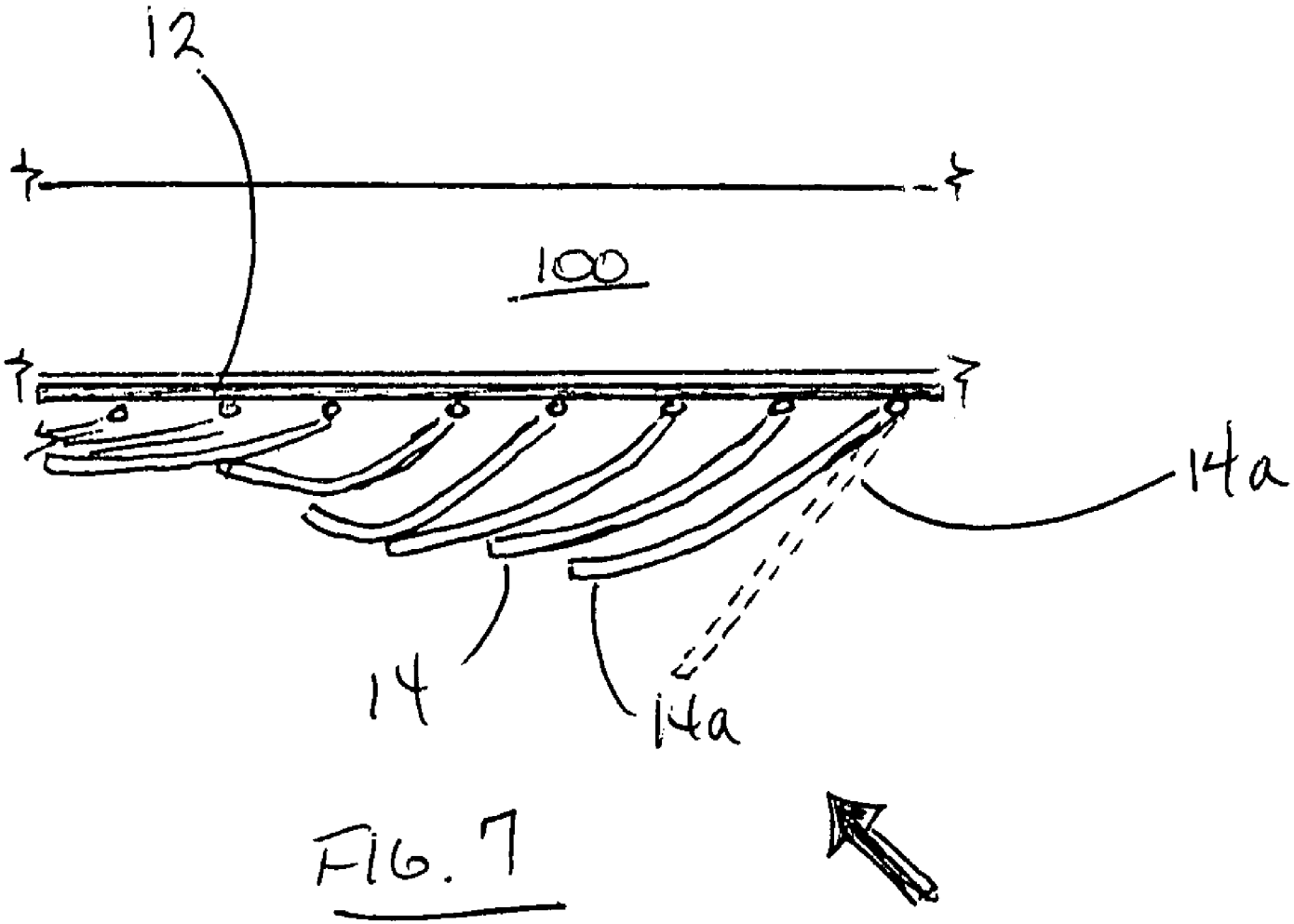
FIG. 7 is a top view of the fins displaced after impact by a vehicle.

Each fin 14 comprises a substantially orthogonal configuration (and depicted in the figures as a rectangular object). Each fin 14 comprises parallel long sides 24 and 26 opposite one another, and parallel short sides 28 and 30 opposite one another. The short sides 28 and 30 are intermediately disposed between long sides 24 and 26 (or conversely, the long sides 24 and 26 are intermediately disposed between short sides 28 and 30). A long side 24 or 26 of each fin 14 is affixed to a respective plate 12 via a weld 32 (envisioned as a fillet weld that securely bonds the fin 14 to the plate 12, while allowing for displacement of the fin 14 upon vehicle impact and minimizing the potential for separation of the fin 14 from the plate 12). The weld 32 traverses the length or height of the long side 24 or 26. The opposing side 24 or 26 is independent and facing the vehicle(s). Each fin 14 is aligned at an angle $\angle\alpha$ of between 25° and 60° from the normal direction of vehicle traffic (as indicated by the directional arrow in FIG. 3). Optimally, the angle $\angle\alpha$ is between 40° and 60° from the normal direction of vehicle traffic. Each fin 14 is equidistantly spaced from adjacent fins 14. Referring to FIG. 7, upon impact (the vector of the impact indicated by the directional arrow in FIG. 7), a first fin 14*a* is displaced and generates a cascade of displacement of fins 14 adjacent said first fin 14*a*, thereby dissipating energy away from the vehicle 102. Frictional energy is generated between adjacent fins 14 during displacement, as adjacent fins 14 contact and rub against one another, and further dissipates energy away from the vehicle 102. After impact, and depending upon the force and energy generated by the impact, the fins 14 remain deformed, yet capable of dissipating energy from subsequent accidents and impacts, provided that the fins 14 have not been separated from the plates 12. If the force of impact was sufficient to separate fins 14 from the plate 12, a replacement plate 12 may be substituted by removing the fasteners 106 that secure the damaged plate 12 to the wall 100. Removal of a damaged plate 12 and replacement by an intact plate 12 are envisioned as requiring less than 15 minutes, dependent mostly on the number of fasteners used and the clean up required. A motor race may be temporarily interrupted to replace a damaged plate 12, which is not an uncommon occurrence at modern motor races.

The plates 12 and fins 14 are fabricated from mild steel, as opposed to other alternative metals, because mild steel is a non-hardened steel that possesses malleable characteristics, particularly advantageous for use in the present invention.

The malleability of the mild steel, as incorporated into the plates 12 and fins 14, allows the plates 12 and fins 14 to deform upon impact without shattering, fracturing and fragmenting into innumerable portions that might cause injury to driver or fan, or that may inflict damage to vehicle, vehicle components, road surface or wall. Furthermore, the malleability and deformable characteristics of mild steel provide a "crush zone" that is capable of absorbing the kinetic energy generated by an accelerating or high velocity vehicle upon a stationary object, such as a wall. The mild steel will absorb and dissipate or transmit the kinetic energy along the fins 14 and subsequently to the plates 12, thereby decelerating the vehicle 102 and dispersing energy that might otherwise cause high velocity changes in direction that usually result in head, neck and chest injuries.

In one embodiment of the present invention, the system 10 comprises a plurality of plates 12 having height, length and width (thickness) dimensions of approximately four feet (4'), eight feet (8') and one-fourth of an inch (¼" or 0.25 inches), although other sizes are envisioned and suitable for stationary objects or barriers of varied proportions. The plurality of fins 14 have dimensions of approximately four feet (4'), eight inches (8") and one-fourth of an inch (¼" or 0.25 inches), although other sizes are envisioned as well. As noted previously, the entire system 10 is fabricated from mild steel, a deformable and malleable metal, and requires no die for casting of any components. Furthermore, no polymeric material is required for cushioning or protection to cushioning, thus no component is subject to UV degradation from exposure to sunlight. The present invention does not require the use of adhesives to secure components to one another, employing mechanical fasteners and welds for high strength, durability, while also providing the necessary deformity to properly dissipate energy upon impact. The present invention provides an alternative to known energy absorbing safety walls currently used, and does so at a significantly reduced cost and may be fabricated in an expedited manner.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the system 10 is envisioned as a modular system, wherein a plurality of plates 12 are installed in adjacent fashion along a stationary object, such as a retaining wall 100 of a motor racing track. Adjacent plates 12 overlap along one vertical margin, so that an offset vertical margin 16 protectively rests exterior to the adjacent planar vertical margin 18 of the adjacent plate 12. The fins 14 are pre-welded at a specified angle from the plate 12, an angle relative to the normal direction of traffic. After fasteners 106 securely place the plates 12 abutting the wall 100, the system 10 is operable for dissipating energy generated by the impact of racing vehicles. Upon impact, the vehicle 102 strikes at least one fin and causes the fin to displace into an adjacent fin, with a cascade of displacement and contact between adjacent fins until the energy is dissipate through the fins 14, through the friction generated by the fins 14 contacting one another during the cascade of displacement, and through energy dissipated into the plate 12. Any damaged plate 12 is easily replaced by a section or module of another undamaged plate 12 by removing the fasteners 106 and replacing.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. An energy absorbing safety barrier system comprising:

a plurality of plates affixed to a retaining wall in an overlapping manner to inhibit shearing of said system and dispersal of sheared objects;

a plurality of fins depending from said plurality of plates, said plurality of fins deformable for dissipating energy generated by impact of a vehicle thereon; and each one of said fins having a free side and an affixed side, wherein a weld traversing the lengths of said affixed side affixes said fin to said plate.

2. The system of claim 1, wherein said plurality of plates are affixed to said retaining wall via fasteners.

3. The system of claim 1, wherein each of said plurality of plates comprises a vertically disposed non-planar margin offset from a plane of said plate for overlapping with a vertically disposed planar margin of an adjacent said plate.

4. The system of claim 1, wherein each of said plurality of plates is fabricated from mild steel to inhibit fracturing of said plurality of plates upon impact and for absorbing and dissipating energy generated by impact.

5. The system of claim 1, wherein each of said plurality of fins is aligned at an angle between 25° and 60° from the normal direction of said vehicle.

6. The system of claim 1, wherein each of said plurality of fins is equidistantly spaced from adjacent said plurality of fins.

7. The system of claim 1, wherein upon impact, a first fin is displaced and generates a cascade of displacement of said plurality of fins adjacent said first fin, thereby dissipating energy away from said vehicle.

8. The system of claim 7, wherein frictional energy generated between adjacent plurality of fins during displacement further dissipates energy away from said vehicle.

* * * * *